United States Patent [19]

Müller et al.

[11] Patent Number: 4,732,334

[45] Date of Patent: Mar. 22, 1988

[54] APPARATUS FOR CRUSHING BRITTLE MATERIAL FOR COMMINUTION

[75] Inventors: Manfred Müller, Ennigerloh; Gerhard Gudat, Oelde, both of Fed. Rep. of Germany

[73] Assignee: Krupp Polysius AG, Beckum, Fed. Rep. of Germany

[21] Appl. No.: 23,528

[22] Filed: Mar. 9, 1987

[30] Foreign Application Priority Data

Mar. 19, 1986 [DE] Fed. Rep. of Germany ..... 3609229

[51] Int. Cl.[4] ..... B02C 4/32

[52] U.S. Cl. ..... 241/79.1; 241/152 A

[58] Field of Search ..... 241/275, 152 A, 78, 241/75, 117–121, 79.1, 14, 24, 29

[56] References Cited

U.S. PATENT DOCUMENTS 3,640,475 2/1972 Jung et al. ..... 241/275 X
4,597,537 7/1986 Misaka et al. ..... 241/119 X

FOREIGN PATENT DOCUMENTS 84383 4/1983 European Pat. Off. .
3302176 7/1984 Fed. Rep. of Germany .
231447 11/1985 Japan ..... 241/152 A
2138319 10/1984 United Kingdom ..... 241/152 A

*Primary Examiner*—Mark Rosenbaum
*Attorney, Agent, or Firm*—Learman & McCulloch

[57] ABSTRACT

The invention relates to apparatus for crushing brittle material for comminution which is subjected to individual grain crushing and material bed crushing in a roll crusher at high pressure and with agglomerates being formed, these agglomerates being loosened in the sifter with the aid of a separate arrangement and removed from the crushing system. In this way a crushing stage which is provided for further crushing has its load significantly reduced and as a result the apparatus is rendered considerably more economical.

10 Claims, 3 Drawing Figures

APPARATUS FOR CRUSHING BRITTLE MATERIAL FOR COMMINUTION

The invention relates to apparatus for crushing brittle material, such as cement clinker, for comminution.

BACKGROUND OF THE INVENTION

It is known, for example, from European Patent Specification No. A-0 084 383 for material to be comminuted to be subjected first to individual grain crushing and material bed crushing in a roll crusher under high pressure with agglomeraters being formed. Then the material is sifted, and the grit produced in the sifting is further comminuted in a mill which is arranged downstream from the crushing apparatus.

According to another known arrangement as set out in German Patent Specification No. A-33 02 176 the agglomerates which form in the roll crusher can also be loosened in an arrangement such as a ball mill, dispersing plate air sifter, or grading screen, arranged after the roll crusher, in which use is made of the disagglomerating effect of a device which is primarily associated with another stage in the process. Thus, if the loosening of the agglomerates is to be carried out for example in a conventional dispersing plate air sifter this creates an additional load on the dispersing or delivery plate of the air sifter, so that quite unsatisfactory loosening of the agglomerates must be expected.

OBJECTS AND ADVANTAGES OF THE INVENTION

The object of the invention is to make further developments to apparatus of this type in such a way that it is distinguished by improved economy and in particular a reduced energy consumption along with effective loosening of the agglomerates.

This object is achieved according to this invention through an arrangement wherein the agglomerates formed in the roll gap of the roll crusher are loosened before sifting, and by a special arrangement inside the sifter. That is to say that this special arrangement is not, as is in the known construction last referred to above, formed solely by the dispersing or delivery plate itself, but rather the rotating plate for delivery of the material for comminution is provided through this invention with impact elements. The high proportion of fine material contained in the agglomerates (lumps) is released from the material for comminution by the action of these impact elements and is removed from the crushing system during the subsequent sifting so that this proportion of fine material is no longer a load on the succeeding crushing stage.

Furthermore, it is advantageous that the plate for delivery of the material for comminution which is provided with impact elements through this invention is driven independently of the sifting device of the sifter. Thus, the sifting and the loosening of the agglomerates can be optimized independently of each other.

In this way the economy of operation of the whole apparatus is significantly improved and there is a marked reduction in the energy requirement as a result of the reduction of the load on the further crushing stage.

It is also advantageous that, because of the reliable loosening of the agglomerates and the resulting improved sifting out of the quantity of fine material contained therein, the crushing stage (generally a ball mill) which is arranged after the sifter can be of smaller dimensions through this invention than in known prior apparatus in which disagglomeration of the material for comminution before sifting is added at a later stage because it has a smaller load.

In addition, in this construction according to the invention the operation of the subsequent crushing stage can be better adapted to the operation of the roll crusher.

THE DRAWINGS

The invention is illustrated by way of example in the drawings, in which.

DETAILED DESCRIPTION

Figure 1:
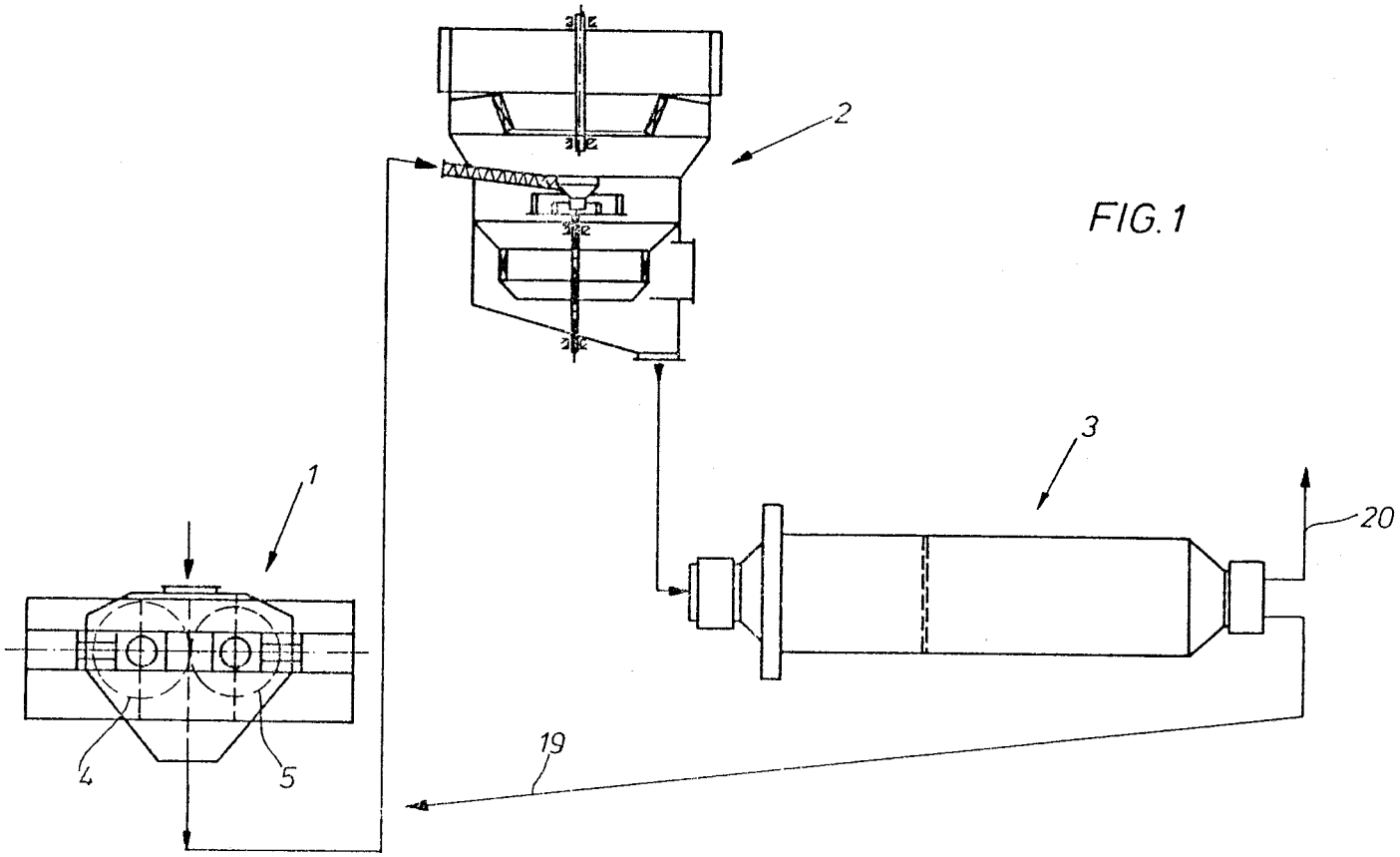
FIG. 1 shows a diagram of a crushing apparatus according to the invention.

The apparatus shown in FIG. 1 for crushing brittle material for comminution, for example cement clinker, contains a roll crusher 1, a sifter 2 with built-in disagglomerator and a ball mill 3.

The roll crusher 1 contains two rolls 4, 5, and in the gap between them the material for comminution undergoes individual grain crushing and material bed crushing at high pressure and with agglomerates being formed.

Figure 2:
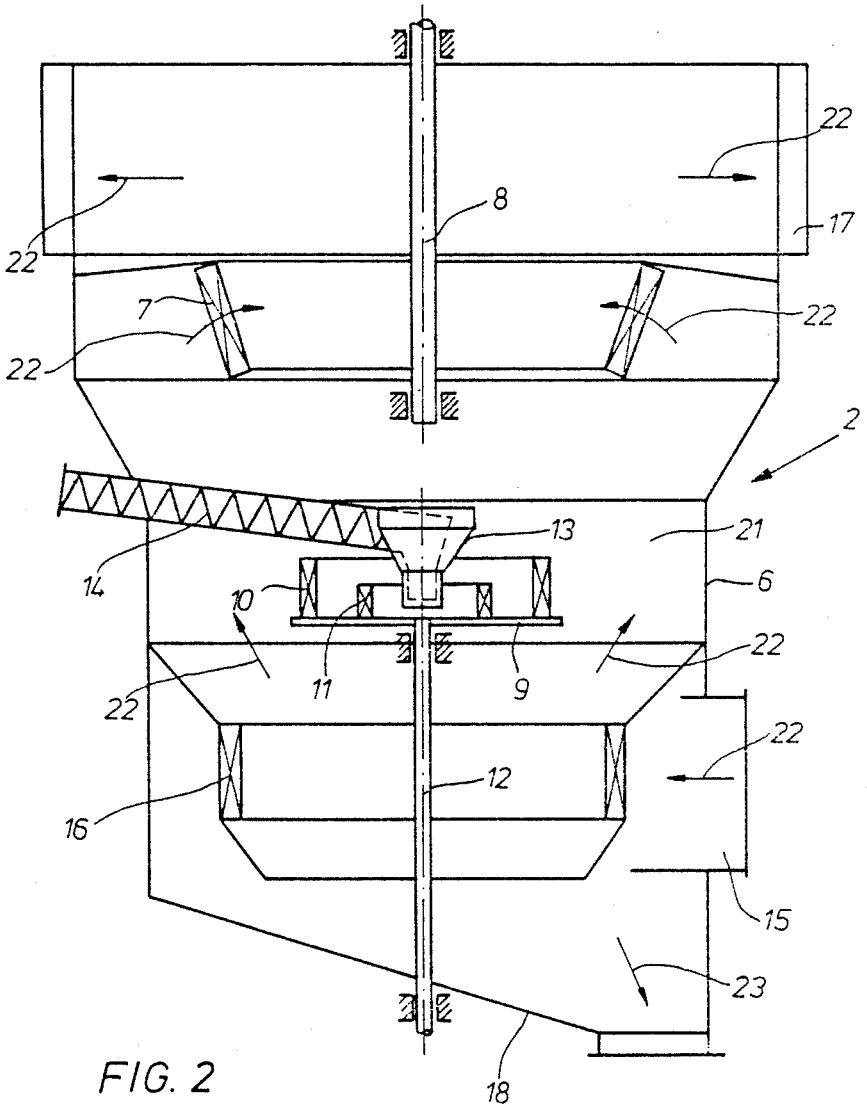
FIG. 2 shows an enlarged schematic section representation of the sifter with built-in disagglomerator of the apparatus according FIG. 1.

The material for comminution discharged from the roll crusher 1 is then delivered to the sifter 2. In the upper part of the housing 6 the sifter 2 the details of which can be seen in FIG. 2, contains a rotating sifting system 7 which is driven by a shaft 8.

A rotating plate 9 for delivery of the material for comminution and which is provided with impact elements 10, 11 of differing height is arranged below the rotating sifting system 7. The plate 9 for the delivery of the material for comminution is driven from below by a shaft 12.

A feed hopper 13 to which the material for comminution is delivered by a screw conveyor 14 is located above the plate 9.

The air for sifting enters via a pipe 15 in the lower region of the housing 6 and then passes through a stationary louvered ring 16. The fine material is led off through the pipe 17 by the sifting air and separated off in a cyclone or filter, which is not shown in FIG. 1.

The grit (arrow 23) is discharged from the housing 6 via a hopper 18 and delivered to the ball mill 3. The grit from the latter is led back to the sifter (arrow 19), while the fine material produced in the ball mill 3 is extracted with the exhaust air from the mill.

Because of the material bed crushing carried out in the roll crusher 1 the material for comminution discharged from the roll crusher 1 contains a high proportion of agglomerates (lumps). These agglomerates are thoroughly loosened in the sifter 2 before they enter the sifting chamber 21 when the material for comminution on the rotating delivery plate 9 passes the impact elements 10 while moving outwards. This loosening of the agglomerates releases the high proportion of fine material contained therein which is then carried upwards by the sifting air (arrows 22) and separated off in a cyclone or filter arranged after the sifter 2. Therefore, the ball mill 3 is only loaded with the grit produced in the sifter 2, and not with the fine material.

Since the sifting system and the plate 9 for delivery of the material for comminution are driven by separate shafts 8 and 12 respectively, the sifting and the loosening of the agglomerates can be optimized independently of each other.

Figure 3:
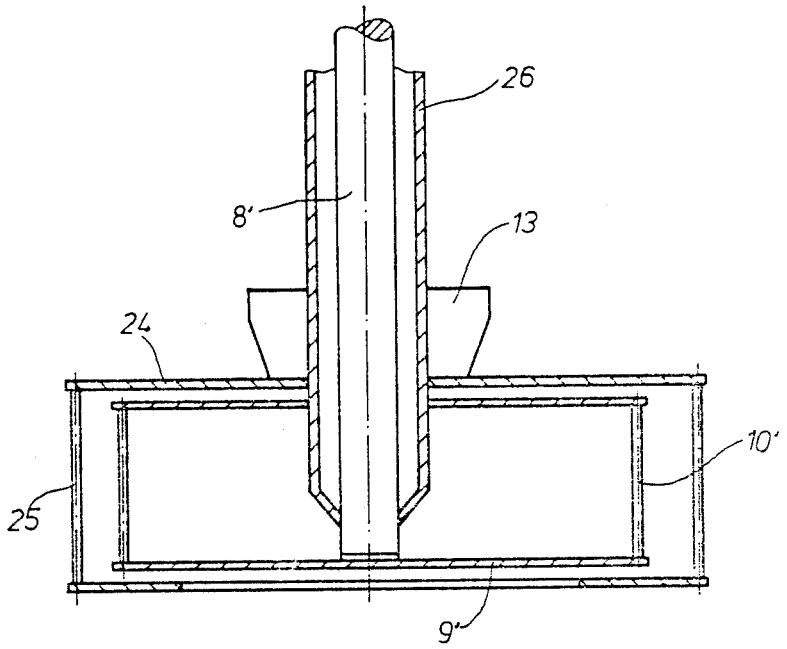
FIG. 3 shows a variant of the disagglomerator.

In the variant of the disagglomerator illustrated in FIG. 3, the plate 9' for delivery of the material for crushing is also provided on its periphery with impact elements 10' and is driven by a core shaft 8', and is arranged inside a further drum 24 which is provided on its periphery with impact elements 25 and driven by an outer shaft 26. The material for comminution is delivered by a feed hopper 13.

The speeds of the shafts 8' and 26 can be selected so as to be different. It is also possible for the outer drum 24 with the impact elements 25 to be arranged stationary and only the material delivery plate 9' to be driven.

In the embodiment illustrated in FIG. 3 there is also an effective loosening of the agglomerates formed in the roll crusher 1 before the material enters the sifting chamber 21 and the sifter 2.

It should be evident that this invention is not limited to the specific embodiments described, but that modification can be made without departing from the scope of the present invention as set forth in the appended claims.

We claim:

1. Apparatus for crushing brittle material comprising a roll crusher in which such material is subjected to individual grain crushing and material bed crushing at high pressure causing the formation of agglomerates; means for supplying said crusher with said material; a sifter downstream from said crusher; means for delivering crushed and agglomerated material from said crusher to said sifter; a rotary distributor mounted in said sifter in a position to receive material delivered thereto from said crusher; means for rotating said distributor at a speed to cause material thereon to move along a path radially outwardly of said distributor for discharge therefrom; impact means mounted in the path of movement of said material for engagement thereby to disagglomerate said material; means for establishing an airstream moving upwardly past said distributor at a velocity to entrain and carry upwardly relative fine disagglomerated material; means for receiving relatively coarse material that is incapable of being entrained in said air stream; rotary sifting means mounted above said distributor and through which said entrained material may pass; and means for rotating said sifting means independently of said distributor.

2. Apparatus according to claim 1 wherein said impact means are mounted on said distributor.

3. Apparatus according to claim 2 wherein said impact means comprises two groups of circumferentially spaced elements of different height.

4. Apparatus according to claim 3 wherein one of said groups is radially inward of the other group.

5. Apparatus according to claim 1 wherein the height of the radially inward group of elements is less than that of the radially outward group of elements.

6. Apparatus according to claim 1 wherein said impact means comprises first impact elements carried by said distributor at its periphery, said distributor being mounted within a drum having additional impact elements radially outward of said first impact elements.

7. Apparatus according to claim 6 including means for rotating said drum independently of said distributor.

8. Apparatus according to claim 7 wherein the means for rotating said distributor comprises a first shaft connected to said distributor and wherein the means for rotating said drum comprises a hollow shaft accommodating said shaft and connected to said drum.

9. Apparatus for crushing brittle material comprising a roll crusher in which such material is subjected to individual grain crushing and material bed crushing at high pressure causing the formation of agglomerates; means for supplying said crusher with said material; a sifter downstream from said crusher; means for delivering crushed and agglomerated material from said crusher to said sifter; a rotary distributor mounted in said sifter in a position to receive material delivered thereto from said crusher; means for rotating said distributor at a speed to cause material thereon to move along a path radially outward of said distributor for discharge therefrom; first impact means carried by said distributor in the path of movement of said material for engagement thereby to disagglomerate said material; rotary, second impact means mounted radially outward of said distributor and in the path of material discharged from said distributor for engagement by such material; means for rotating said second impact means; and means for establishing an airstream moving upwardly past said distributor and said second impact means at a velocity to entrain and carry upwardly into said sifter relatively fine disagglomerated material.

10. Apparatus according to claim 9 wherein said means for rotating said distributor and said means for rotating said second impact means are independent of one another.

* * * * *